US008857351B2

(12) United States Patent
Zimmer et al.

(10) Patent No.: US 8,857,351 B2
(45) Date of Patent: Oct. 14, 2014

(54) MODULAR SUPPORT ASSEMBLY WITH FORTIFYING FLANGE

(75) Inventors: Ronald A. Zimmer, Dewitt, IA (US); Alan W. Knapper, McCausland, IA (US)

(73) Assignee: Custom-Pak, Inc., Clinton, IA (US)

( * ) Notice: Subject to any disclaimer, the term of this patent is extended or adjusted under 35 U.S.C. 154(b) by 1100 days.

(21) Appl. No.: 11/211,510

(22) Filed: Aug. 25, 2005

(65) Prior Publication Data

US 2007/0044692 A1 Mar. 1, 2007

(51) Int. Cl.

*A47B 13/00* (2006.01)
*A47B 87/02* (2006.01)
*A47B 47/04* (2006.01)

(52) U.S. Cl.

CPC ..... *A47B 87/0215* (2013.01); *A47B 87/0253* (2013.01); *A47B 47/04* (2013.01)
USPC ..... 108/157.16

(58) Field of Classification Search

USPC ..... 108/162, 165, 180, 158.12, 153.1, 108/157.1, 157.11, 157.12, 157.13, 157.14, 108/157.15, 157.16, 157.17, 157.18; 248/188.5

See application file for complete search history.

(56) References Cited

U.S. PATENT DOCUMENTS

| | | | | |
|---|---|---|---|---|
| 1,776,071 | A * | 9/1930 | Horwath | 108/157.16 |
| 1,956,389 | A * | 4/1934 | Kintz | 47/68 |
| 3,807,572 | A | 4/1974 | Luvara et al. | |
| 3,881,794 | A | 5/1975 | Henning | |
| 3,933,401 | A | 1/1976 | Lampe et al. | |
| 4,057,308 | A | 11/1977 | Dunning, III | |
| 4,169,639 | A * | 10/1979 | Zola | 312/265 |
| 4,355,585 | A * | 10/1982 | Bottamiller et al. | 108/157.13 |
| 4,998,023 | A | 3/1991 | Kitts | |
| 5,100,090 | A | 3/1992 | Drower | |
| 5,218,912 | A | 6/1993 | Buske | |
| D350,247 | S | 9/1994 | Buske | |
| 5,368,380 | A * | 11/1994 | Mottmiller et al. | 312/263 |
| 5,370,064 | A * | 12/1994 | Sgabellone | 108/162 |
| 5,433,518 | A | 7/1995 | Skov | |
| 5,613,746 | A * | 3/1997 | Green et al. | 312/194 |
| 5,704,699 | A | 1/1998 | Pagelow et al. | |
| 5,803,561 | A * | 9/1998 | Puehlhorn | 312/264 |
| 6,260,488 | B1 | 7/2001 | Yang et al. | |
| D479,925 | S | 9/2003 | Hsieh et al. | |

(Continued)

FOREIGN PATENT DOCUMENTS

| | | |
|---|---|---|
| DE | 94 19 199 | 1/1995 |
| DE | 20 2004 001 391 | 6/2004 |

OTHER PUBLICATIONS

European Search Report, Dec. 5, 2006, 6 pages.

*Primary Examiner* — Matthew Ing
(74) *Attorney, Agent, or Firm* — St.Onge Steward Johnston & Reens LLC

(57) ABSTRACT

A modular support assembly generally comprising vertical support members and a horizontal support member, such as a shelf, for supporting objects. The horizontal support member includes a main panel portion and flange portions connected along the sides of the panel for fortifying same. The vertical support members have cavities on their inner surfaces, and the horizontal support members have protrusions at their ends corresponding to the cavities. In some embodiments, the flanges are hingedly connected to the panel such that they pivot between a flat position and a supporting position perpendicular to the panel. In certain embodiments, the protrusions are integrally formed with extend out from the flanges. In some embodiments, the assembly is blow-molded article.

2 Claims, 7 Drawing Sheets

(56) References Cited

U.S. PATENT DOCUMENTS

| | | | | |
|---|---|---|---|---|
| 6,634,511 | B2 | 10/2003 | Manghera | |
| 6,722,292 | B2 | 4/2004 | Salmanson et al. | |
| 6,826,887 | B2 | 12/2004 | Skov | |
| 6,827,028 | B1 * | 12/2004 | Callaway | 108/158.12 |
| 2003/0217676 | A1 * | 11/2003 | Strong et al. | 108/127 |
| 2006/0169659 | A1 * | 8/2006 | Robinson et al. | 211/187 |

* cited by examiner

MODULAR SUPPORT ASSEMBLY WITH FORTIFYING FLANGE

FIELD OF THE INVENTION

The present invention relates to an assembly for providing a modular support structure. More specifically, the invention relates to a support structure where the horizontal members, such as shelves, have a fortifying flange to increase the weight bearing capacity of the shelf.

BACKGROUND OF THE INVENTION

Modular support assemblies, such as shelving, are generally well known in the art. These devices typically separate, individual vertical support members, such as posts or panels, and horizontal shelf panels. Various mechanisms are then employed to connect the horizontal panels to the vertical support members, some examples of which are disclosed in U.S. Pat. No. 6,634,511 to Manghera, in U.S. Pat. No. D479, 925 to Hsieh at al., in U.S. Pat. No. 6,260,488 to Yang et al., and in U.S. Pat. No. 6,722,292 to Salmanson.

One method that has been employed to create such support assemblies is the use of blow molding. Typically, this process involves the use of a mold consisting of two separate halves or portions having cavities of particularly desired shapes and sizes. Usually, one extrudes a large-diameter, sealed tube of molten material (commonly referred to as a "parison"), places the tube between the mold halves, and closes the mold around the tube. Fluid pressure is then introduced into the tube, forcing the molten tube against the walls of the cavities, conforming the tube to the shape thereof. The pressure is maintained until the molten material cools and solidifies. The pressure is then released, the mold halves are pulled apart, and the hardened article is ejected therefrom. An example of this process is disclosed in U.S. patent application Ser. No. 10/958,824 in the names of Bahnsen et al., the specification of which is incorporated herein by reference.

Because this is a relatively simple way of producing a double wall article, which is both inexpensive and lightweight, yet durable, it is not uncommon to use this method for manufacturing support structures, such as shelving. By producing the panels in this manner, one is able to produce shelving that is relatively strong despite its lighweight character, such as is disclosed in U.S. Pat. No. 4,998,023 to Kitts.

However, one disadvantage that remains with many of these systems is that assembling and disassembling the support structures can still be time consuming and often requires special tools. Another significant disadvantage of the aforementioned blow-molded structures and other plastic assemblies is that the rigidity of the horizontal panels, though good, is still limited. Therefore, depending in part on both the length and the specific thickness of the walls of the panel, the shelf will only be able to bear a certain amount of weight before beginning to bow under the stress.

Accordingly, it has been suggested to strengthen these support assemblies by altering the structure of the shelf panel. An example of such a system is disclosed in U.S. Pat. No. 6,826,887 to Skov. By blow molding a panel such with a multitude of transverse or lateral beams and ribs disposed within the beam that project from a first panel to a second panel thereby providing additional support to weight bearing surface.

However, assemblies such as these not only require detailed mold designs to create the various beams and ribs, but still result in structures that, due to their extended, horizontal nature, have a limited strength to weight ratio.

What is desired, therefore, is modular support assembly that easy to assemble and disassemble. What is further desired is modular support assembly that is both lightweight and also able to bear a lot of weight. What is also desired is modular support assembly that can be manufactured easily and inexpensively.

SUMMARY OF THE INVENTION

Accordingly, it is an object of the present invention to provide a modular support assembly that can be assembled and disassembled without tools.

It is a further object of the present invention to provide a modular support assembly that is lightweight.

It is yet another object of the present invention to provide a modular support assembly where the horizontal panels are fortified.

It is still another object of the present invention to provide a modular support assembly that minimizes the amount of material required to manufacture the horizontal panel members.

It is another object of the present invention to provide a modular support assembly that does not require the use of a complex mold.

In order to overcome the deficiencies of the prior art and to achieve at least some of the objects and advantages listed, the invention comprises a support assembly including a vertical support member having a side surface and a top, a horizontal support member having first and second ends, the horizontal support member comprising a panel for supporting objects, the panel having a top surface, a bottom surface, and first and second sides and a flange connected to the first side of the panel for fortifying the panel, at least one protrusion extending outwardly from the first end of the horizontal support member, and at least one cavity in the side surface of the vertical support member for accomodating the at least one protrusion.

In some of these embodiments, the flange is hingedly connected to the first side of the panel such that the flange is movable from a first position to a second position with respect to the panel, the flange being substantially coplanar with the panel when in the first position, and the flange being substantially perpendicular to the panel when in the second position.

In another embodiment, the invention comprises a support assembly including a first double wall, blow molded vertical support member having a top, a side surface, and first and second cavities in the side surface, a second double wall, blow molded vertical support member having a top, a side surface, and first and second cavities in the side surface, and a double wall, blow molded horizontal support member comprising a panel portion for supporting objects, the panel having a top surface, a bottom surface, and first and second sides, and first and second flange portions connected to the first and second sides of the panel portion, respectively, such that the flange portions are movable from a first position to a second position with respect to the panel portion, wherein the first flange portion has a first end with a protuberance corresponding to the first cavity of the first vertical support member when the flange portion is in the second position, and a second end with a protuberance corresponding to the first cavity of the second vertical support member when the flange portion is in the second position, and wherein the second flange portion has a first end with a protuberance corresponding to the second cavity of the first vertical support member when the flange portion is in the second position, and a second end with a protuberance corresponding to the second cavity of the second vertical support member when the flange portion is in the second position.

In yet another embodiment, the invention comprises a support assembly including a vertical support member having a side surface and a top, a horizontal support member having first and second ends, the horizontal support member comprising a panel for supporting objects, the panel having a top surface, a bottom surface, and first and second sides, and a flange connected to the first side of the panel, the flange extending downwardly from the panel and substantially perpendicular thereto, at least one protrusion extending outwardly from the first end of the horizontal support member, and at least one cavity in the side surface of the vertical support member for accomodating the at least one protrusion.

DETAILED DESCRIPTION OF THE DRAWINGS

Figure 1:
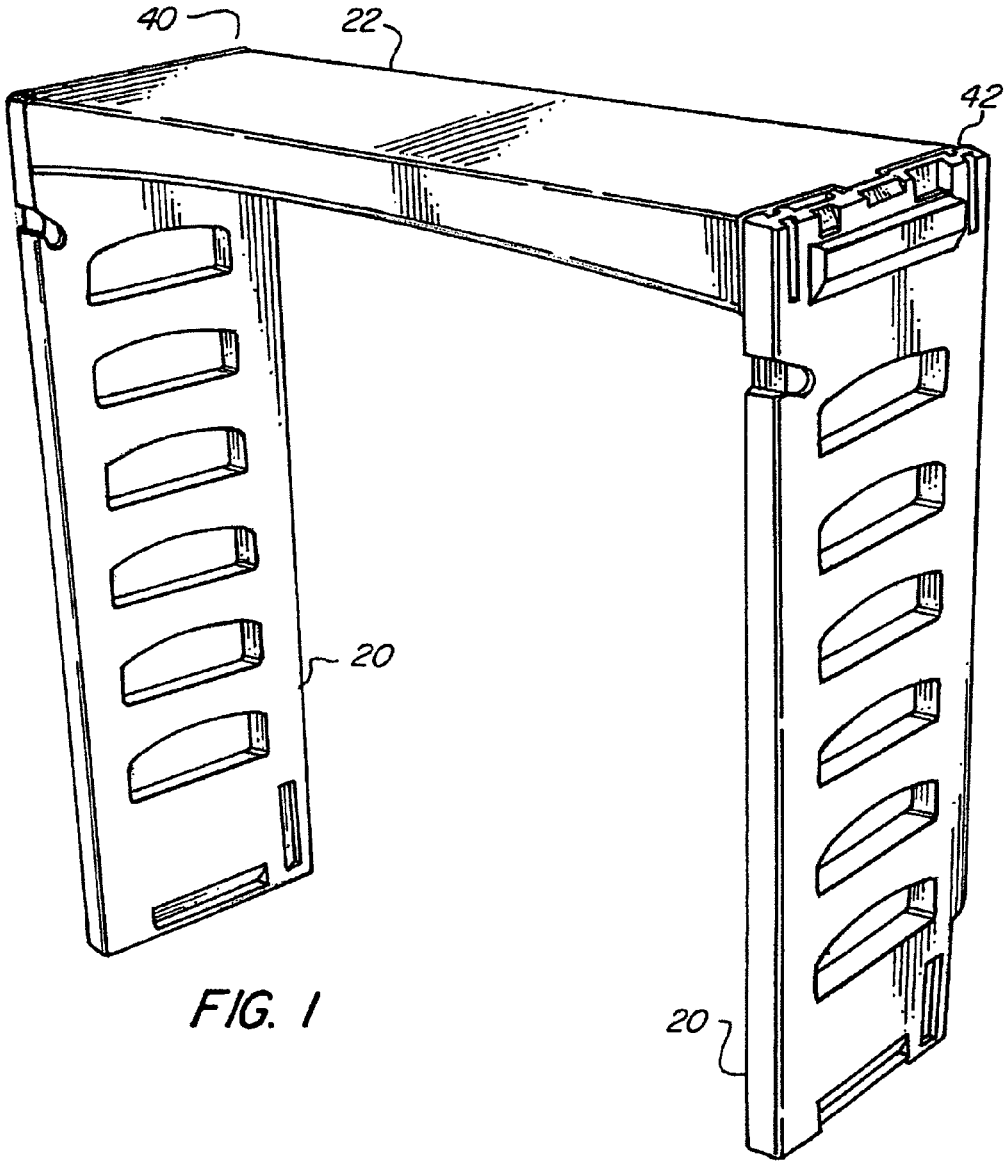
FIG. 1 is an isometric view of a support assembly in accordance with the invention.

The basic components of one embodiment of a modular support assembly 10 in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The assembly 10 includes vertical support members 20 and a horizontal support member 22. As illustrated in FIG. 1, when fully assembled, the horizontal support member 22 acts as a shelf, upon which one can store various objects, and is connected to the vertical support members 20 at its first and second ends 40, 42.

As shown in detail in FIGS. 2A-D, the horizontal support member 22 includes a main panel portion 24 and two flange portions 26, 28. The panel portion 24 includes a top surface 30, where objects are placed, and a bottom surface 32. Though a number of shapes and sizes are possible, in some embodiments, the horizontal member 22 is simply a standard rectangular shelf having elongated first and second sides 34, 36, and the flange portions 26, 28 are connected to the main panel portion 24 at the first and second sides 34, 36. While is some embodiments, a single flange 26 is employed, in certain advantageous embodiments, first and second flanges 26, 28 are used in order to maximize, and more equally distribute, the support provided for the panel portion 24.

Figure 4A:
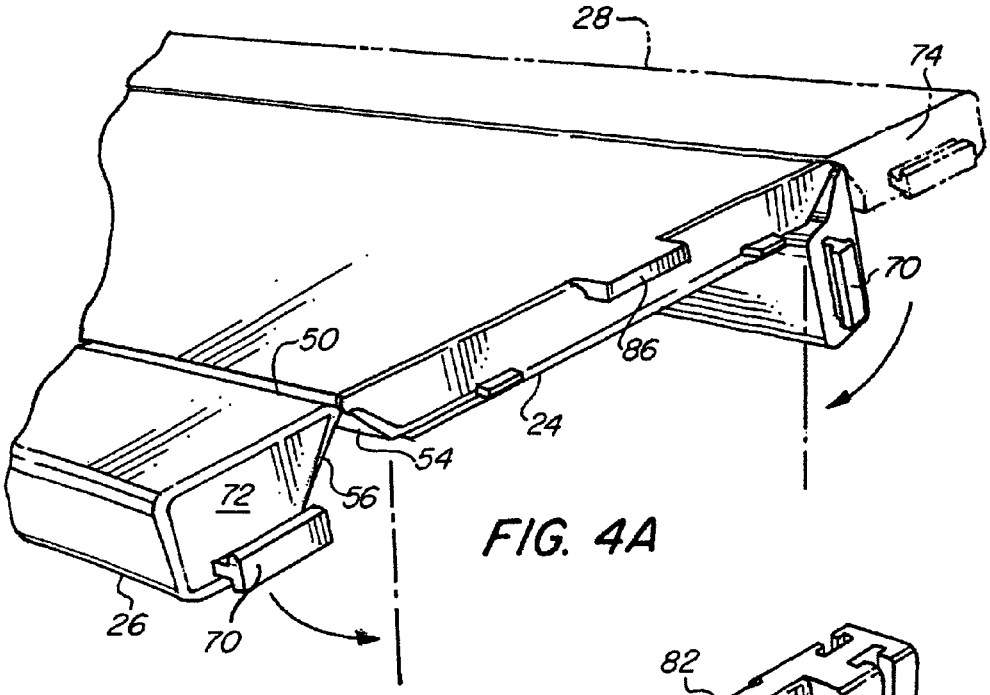
FIG. 4A is an isometric view of the horizontal support member of FIGS. 2A-D.

In certain advantageous embodiments, the flanges 26, 28 are hingedly connected to the sides 34, 36 of the panel 24. For example, in some embodiments, the flanges 26, 28 are integrally formed with the panel 24, and thin strips of material 50, 52 are created between the flanges 26, 28 and the sides 34, 36, respectively, that allows the flanges 26, 28 to pivot with respect to the panel 24, as is more clearly illustrated in FIG. 4A. These hinged connections 50, 52 may be created, for example, by pinching a portion of a parison during blow-molding, as is further described below. The side 34 and the edge of the flange 26 adjacent the side 34 have mating inclined surfaces 54, 56, respectively, thereby permitting the pivoting motion of the flange 26. In this way, as shown in FIG. 4A, the flange 26 can moved from a first, flattened position, where the flange 26 is substantially co-planar with the panel 24, to a second, in-use position, where the flange 26 is substantially perpendicular to the panel 24.

As noted above, in certain advantageous embodiments, the horizontal support member 22 is a double wall, blow molded member. Similarly, in some embodiments, the vertical support members 20 are also blow molded. As previously described, this typically involves introducing fluid pressure into a parison to force the molten tube against the walls of shaped cavities in two mold halves that have been closed around the parsion. During the manufacture of the horizontal member 22, at least one of the mold halves will have a protrusion near each of its sides, at the locations where it is desired to have the panel portion 24 end and the flange portions 26, 28 begin, in order to "pinch" the parison in these two spots, thereby creating the hinged connections 50, 52 between the panel portion 24 and the flanges 26, 28. Accordingly, with respect to the production of the main surface areas of the horizontal member 22 (i.e., top and bottom surfaces 30, 32), very little modification is required to the standard mold ordinarily employed for making a ordinary double wall panels in order to create the flanges 26, 28—namely, the two protrusions located near each side of one of the mold halves.

The horizontal support member 22 is connected to the vertical support members 20 by a number of protrusions 70 extending outwardly from its first and second ends 40, 42 of the member 20. In certain advantageous embodiments using a blow molded horizontal member 22, the protrusions 70 are integrally formed with the member 22, which can simply be formed by employing additional cavities along the main surfaces of the mold halves. Accordingly, when the walls of the blow-molded member 22 are blown against the surfaces of the mold, the resulting walls will include these protuberances.

Figure 3A:
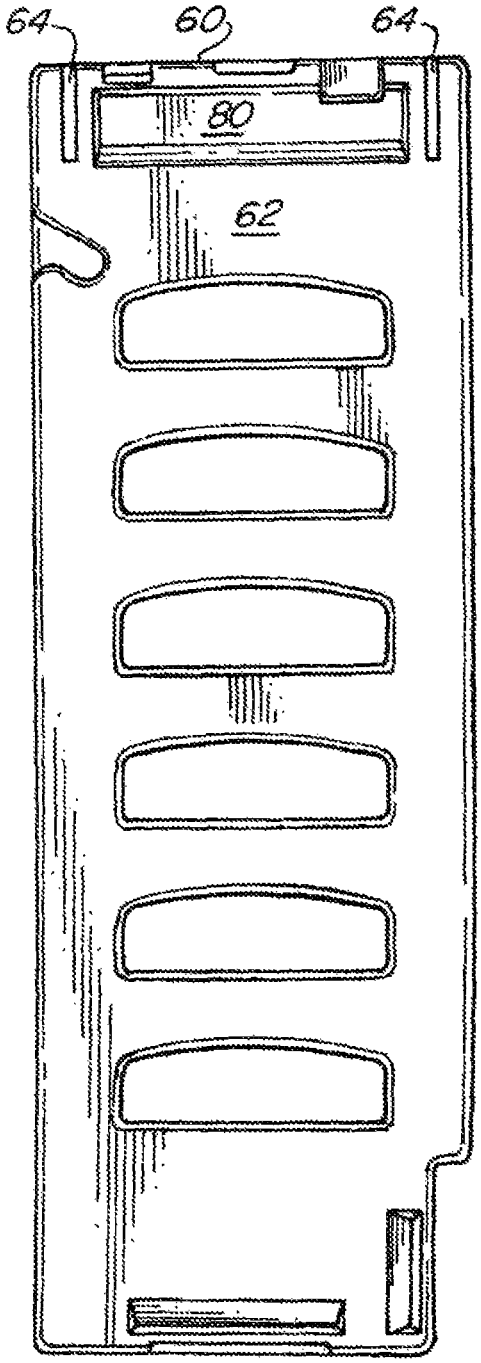
FIG. 3A is a side view of the vertical support member of the support assembly of FIG. 1.
Figure 3B:
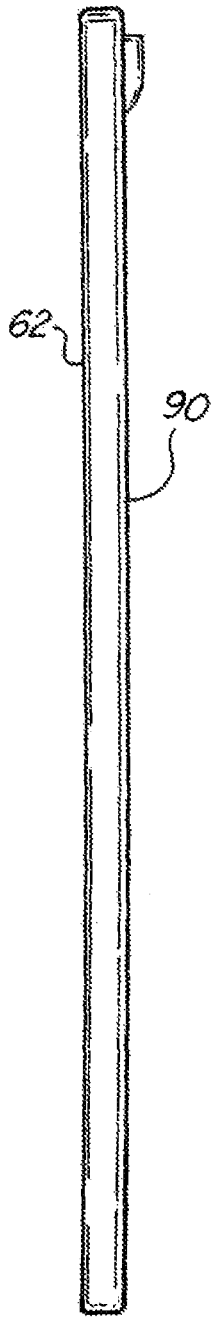
FIG. 3B is a side view of the vertical support member of FIG. 3A.
Figure 4B:
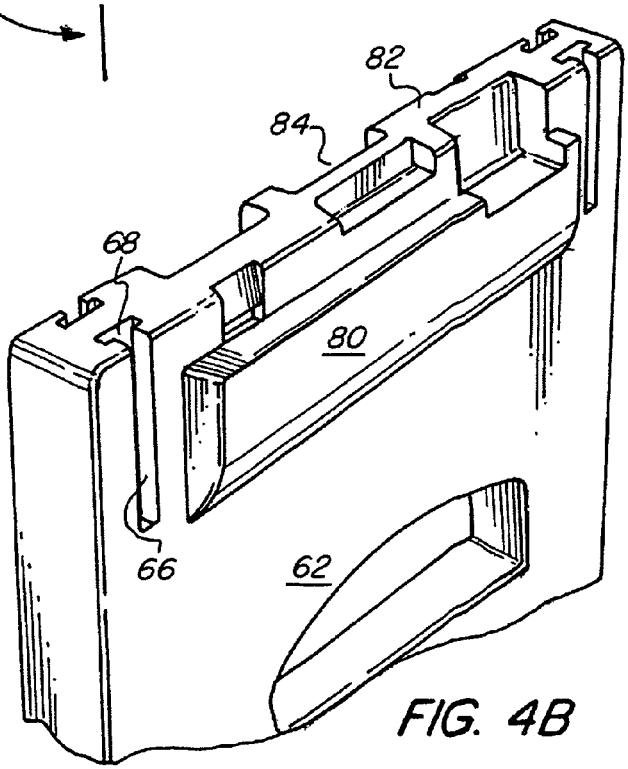
FIG. 4B is an isometric view of the vertical support member of FIGS. 3A-B.

As illustrated in FIGS. 3A-B, the vertical support members 20 each have a top 60 and an inner side surface 62. The inner surface 62 has a number of cavities 64 that correspond to the protrusions 70. In certain advantageous embodiments, each cavity 64 is formed from an opening 66 in the side surface 62 of the vertical member 20, and a channel 68 that extends from the top 60 down the member 20 for a specific length corresponding to the length of the protrusion 70, as is more clearly illustrated in FIG. 4B. Accordingly, the protrusion 70 can be inserted into the cavity 64 from the top 60 of the vertical member 20. The shape of the protrusion 70 corresponds to the shape of the cavity 64, and the maximum width of the opening

Figure 4C:
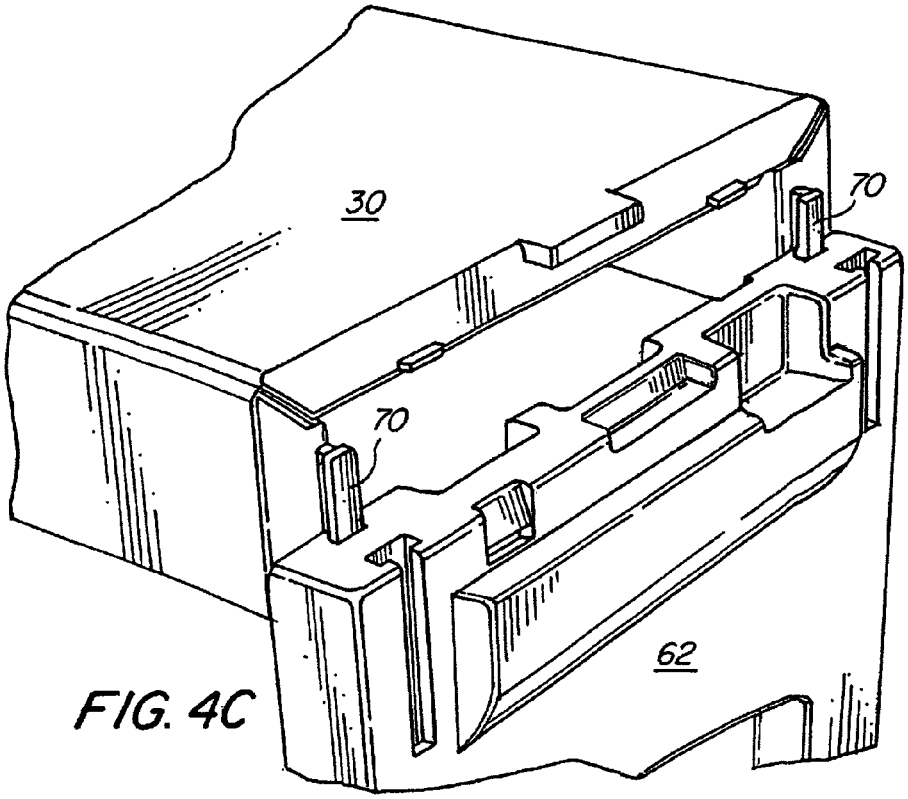
FIG. 4C is an isometric view of the horizontal support member of FIG. 4A partially connected to the vertical support member of FIG. 4B.
Figure 4D:
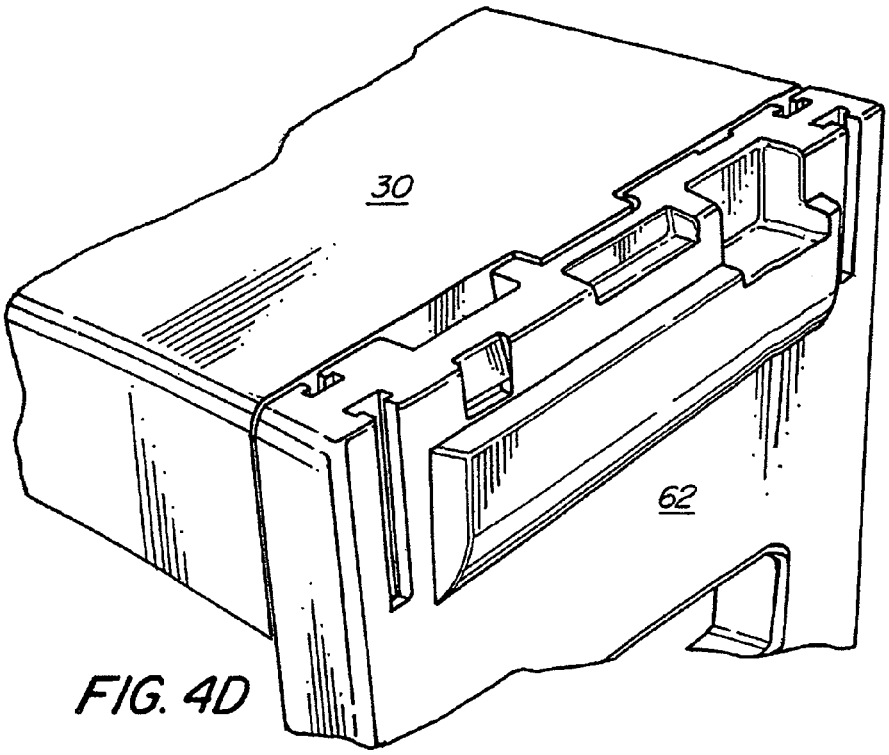
FIG. 4D is an isometric view of the horizontal support member of FIG. 4A fully connected to the vertical support member of FIG. 4B.
Figure 5:
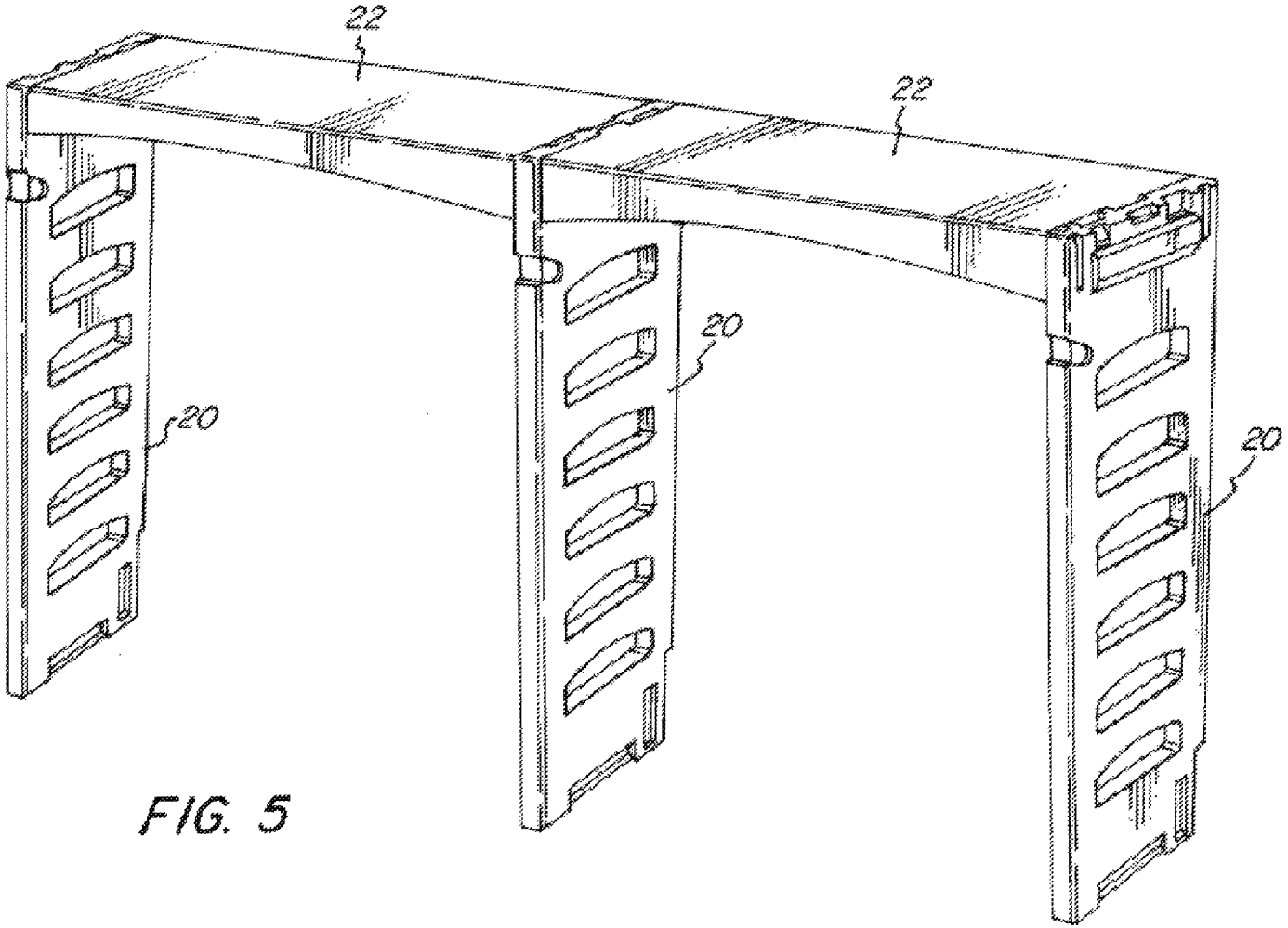
FIG. 5 is an isometric view of the support assembly of FIG. 1 with additional horizontal and vertical members.

66 is smaller than the maximum width of the channel 68, and thus, once the protrusion has been inserted into the channel 68, lateral movement is restricted. This process of inserting the protrusions 70 into the cavities 64, thereby connecting the horizontal support member 22 to the vertical support member 20, is illustrated in FIGS. 4C-D.

In certain advantageous embodiments, the protrusions 70 project outwardly from the flanges 26, 28 and extend longitudinally down the ends 72, 74 thereof. Accordingly, when the flanges 26, 28 are in the second position (FIGS. 4C-D), the protrusions on the flanges correspond to, and are insertable into, the channels 68, thereby maximizing the amount of support provided.

Figure 2A:
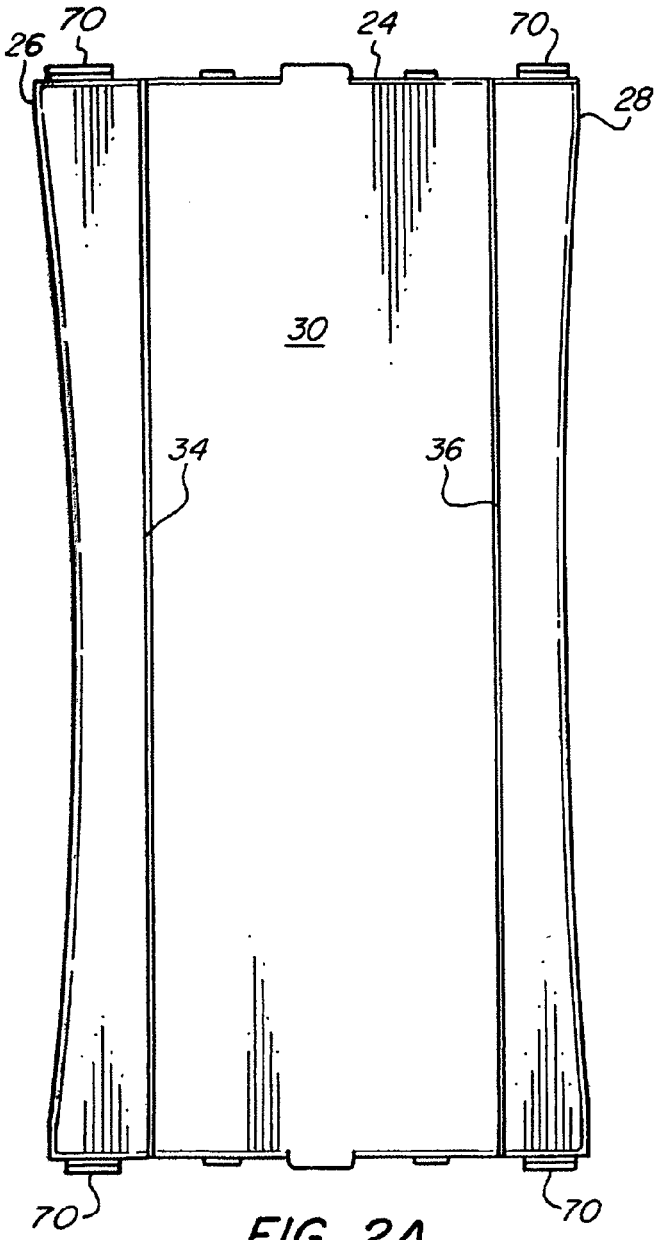
FIG. 2A is a top view of the horizontal support member of the support assembly of FIG. 1.
Figure 2B:
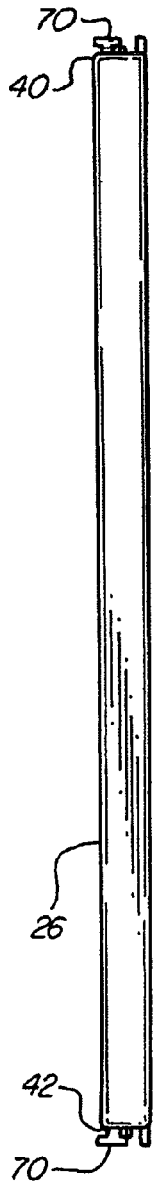
FIG. 2B is a side view of the horizontal support member of FIG. 2A.
Figure 2C:
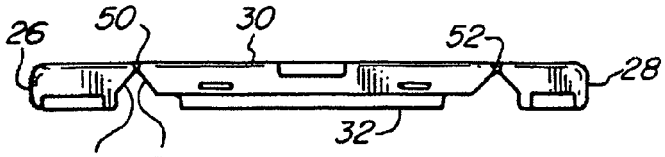
FIG. 2C is an end view of the horizontal support member of FIG. 2A.
Figure 2D:
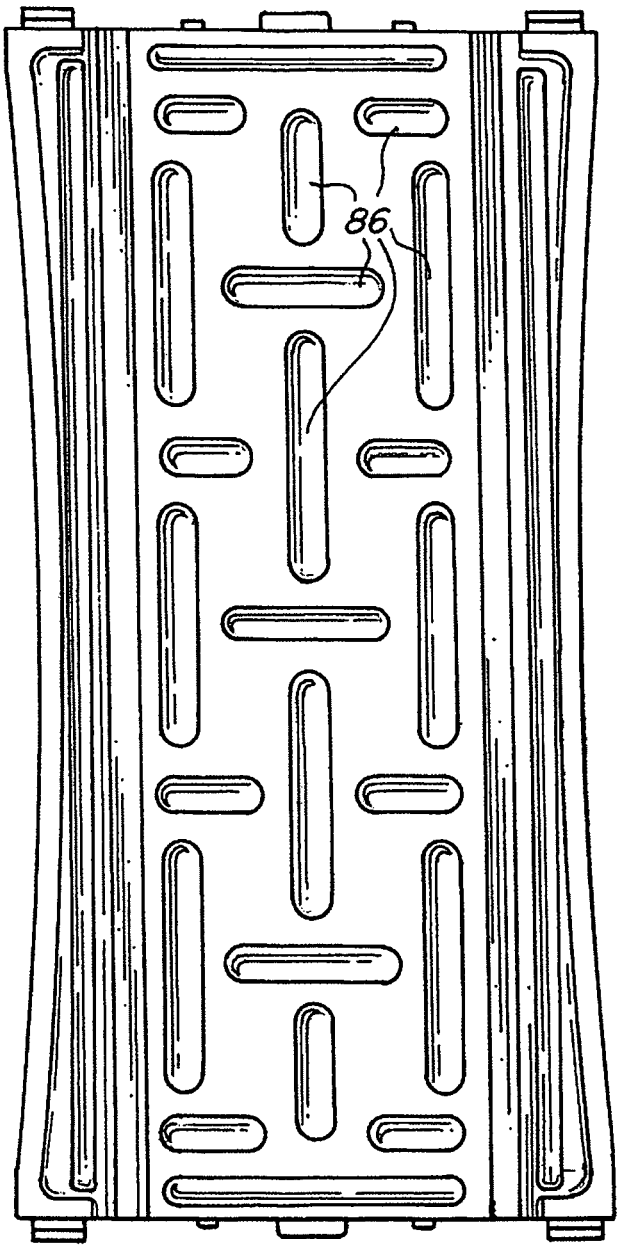
FIG. 2D a bottom view of the horizontal support member of FIG. 2A.

In certain advantageous embodiments, the side surface 62 includes a boss 80 for engaging the bottom surface 32 of the horizontal member 22 to provide additional support. Additionally, in some embodiments, the top 60 of the vertical member 20 includes a top wall 82 that has a recess 84 therein, and the horizontal member 22 has a lip 86 substantially coplanar with the top surface 30 and extending outwardly therefrom, which engages the recess 84 to facilitate alignment and provide even more support. Also, in some embodiments (as shown in FIG. 2D), the bottom surface 32 of the horizontal member 22 includes a plurality of recesses 86 to further improve the structural integrity of the panel 24.

In certain advantageous embodiments, each vertical support member 20 has a second side surface 90, which also includes cavities 64 for receiving protrusions 70 of a horizontal support member 22. Thus, horizontal support members 22 can be connected to the vertical support member 20 on both sides thereof, thereby creating a longer support structure.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A support assembly comprising:

a vertical support member having a side surface and a top;

a horizontal support member having first and second ends, said horizontal support member comprising a panel for supporting objects, said panel having a top surface, a bottom surface, and first and second side edges; and a flange connected to the first side edge of said panel for fortifying said panel;

at least one protrusion extending outwardly from the first end of said horizontal support member; and at least one cavity in the side surface of said vertical support member for accommodating said at least one protrusion;

wherein the top of said vertical support member includes a top wall having a recess therein; and wherein the first end of said panel includes a lip substantially coplanar with the top surface of said panel and extending outwardly therefrom for engaging said recess.

2. A support assembly comprising:

a first double wall, blow molded vertical support member having a top, a side surface, and first and second cavities in the side surface;

a second double wall, blow molded vertical support member having a top, a side surface, and first and second cavities in the side surface; and a double wall, blow molded horizontal support member comprising a panel portion for supporting objects, said panel having a top surface, a bottom surface, and first and second side edges; and first and second flange portions connected to the first and second side edges of said panel portion, respectively, such that said flange portions are movable from a first position to a second position with respect to said panel portion;

wherein said first flange portion has a first end with a protuberance corresponding to the first cavity of said first vertical support member when said flange portion is in the second position, and a second end with a protuberance corresponding to the first cavity of said second vertical support member when said flange portion is in the second position; and wherein said second flange portion has a first end with a protuberance corresponding to the second cavity of said first vertical support member when said flange portion is in the second position, and a second end with a protuberance corresponding to the second cavity of said second vertical support member when said flange portion is in the second position;

wherein the top of each of said vertical support members includes a top wall having a recess therein; and wherein the first and second ends of said panel portion each include a lip substantially coplanar with the top surface of said panel portion and extending outwardly therefrom for engaging the corresponding recess in the tops of said vertical support members.

* * * * *